US011530824B2

(12) United States Patent
Metzger et al.

(10) Patent No.: US 11,530,824 B2
(45) Date of Patent: Dec. 20, 2022

(54) PACKAGED WATER-COOLED AIR TURNOVER UNIT

(71) Applicant: MJC, Inc., Acworth, GA (US)

(72) Inventors: Edward H. Metzger, Acworth, GA (US); William Harris, Acworth, GA (US); George Czyz, Acworth, GA (US); Sean Mocarski, Acworth, GA (US); Russell E. Smith, Acworth, GA (US); Hue Nguyen, Acworth, GA (US); Damon Rundell, Acworth, GA (US)

(73) Assignee: MJC, Inc., Cartersville, GA (US)

( * ) Notice: Subject to any disclaimer, the term of this patent is extended or adjusted under 35 U.S.C. 154(b) by 0 days.

(21) Appl. No.: 16/433,750

(22) Filed: Jun. 6, 2019

(65) Prior Publication Data

US 2019/0376703 A1 Dec. 12, 2019

Related U.S. Application Data

(60) Provisional application No. 62/681,264, filed on Jun. 6, 2018.

(51) Int. Cl.

| | |
|---|---|
| ***F24F 5/00*** | (2006.01) |
| ***F24F 13/30*** | (2006.01) |
| ***F25B 39/04*** | (2006.01) |

(52) U.S. Cl.

CPC ..... *F24F 5/001* (2013.01); *F24F 13/30* (2013.01); *F25B 39/04* (2013.01); *F25B 2339/047* (2013.01)

(58) Field of Classification Search

CPC ..... F24F 5/001; F24F 13/30; F24F 2221/34; F24F 13/20; F25B 39/04; F25B 2339/047; F25B 2400/075; F25B 5/02

See application file for complete search history.

(56) References Cited

U.S. PATENT DOCUMENTS

| | | | | |
|---|---|---|---|---|
| 8,250,881 | B1 * | 8/2012 | Reihl | F25D 25/028 62/451 |
| 2005/0198976 | A1 * | 9/2005 | Wright | F24F 3/153 62/93 |
| 2008/0060586 | A1 * | 3/2008 | Lewis | A01K 1/033 119/500 |
| 2010/0003552 | A1 * | 1/2010 | Kelly | H01M 8/12 429/411 |
| 2010/0251739 | A1 * | 10/2010 | Mabru | B63J 2/04 62/240 |
| 2015/0362213 | A1 * | 12/2015 | Mueller | F24H 9/2085 126/110 C |

FOREIGN PATENT DOCUMENTS

| | | | | |
|---|---|---|---|---|
| CA | 3031935 | A1 * | 2/2018 | A47B 81/00 |
| DE | 10209994 | A1 * | 9/2003 | F24F 3/1405 |

* cited by examiner

*Primary Examiner* — Emmanuel E Duke
(74) *Attorney, Agent, or Firm* — Lee & Hayes, P.C.

(57) ABSTRACT

A packaged air turnover unit is described herein. The packaged air turnover comprises a compressor and condenser within a housing of the packaged air turnover unit. The packaged air turnover unit further includes one or more heat exchanges to cool air and one or more heaters to heat air, providing either cooling or heating to a space depending on the configuration of the unit.

3 Claims, 2 Drawing Sheets

PACKAGED WATER-COOLED AIR TURNOVER UNIT

CROSS REFERENCE TO RELATED APPLICATIONS

This application claims the benefit of U.S. Provisional patent application No. 62/681,264 filed Jun. 6, 2018 entitled "Packaged Water-Cooled Air Turnover Unit," which is expressly incorporated herein by reference in its entirety.

BACKGROUND

Air turnover units (ATU) have conventionally been installed in locations to provide heating and cooling to relatively large spaces. Designs of various ATUs can provide more efficient heating/cooling than what may be provided in conventional air conditioning units, often without the need for ductwork. Conventional ATUs usually include fans that pull air in from a space and move the air across a heating or cooling element. For example, some ATUs include propane or electric heating elements that, when initialized, provide a warm surface or warm air, which is mixed with the incoming air from the fans and exhausted as hot air. The cooling operation is often similar, with the incoming air being mixed or placed in contact with cool air or a cool surface. To provide heating, ATUs often use direct, indirect, or heat injector heating. For cooling, ATUs typically have coils in the unit that receive refrigerant from a remote air conditioning unit. The air is pulled through the coils, heating the refrigerant prior to returning to the air conditioning unit.

It is with respect to these and other considerations that the disclosure made herein is presented.

SUMMARY

The following detailed description is directed to technologies for a packaged air turnover unit. in some examples, the packaged air turnover unit includes one or more compressors within the housing of the packaged air turnover unit. In further examples, the packaged air turnover unit would further include one or more water-cooled condensers to reduce the temperature of incoming air in a cooling mode. In additional examples, the packaged air turnover unit further includes a fan to pull air into the packaged air turnover unit or a fan to push air into the air turnover unit. In still further examples, the packaged air turnover unit further includes a heater to increase the temperature of incoming air when the packaged air turnover unit is in a heating mode. These and various other features will be apparent from a reading of the following Detailed Description and a review of the associated drawings.

This Summary is provided to introduce a selection of technologies in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure

DETAILED DESCRIPTION

Figure 1:
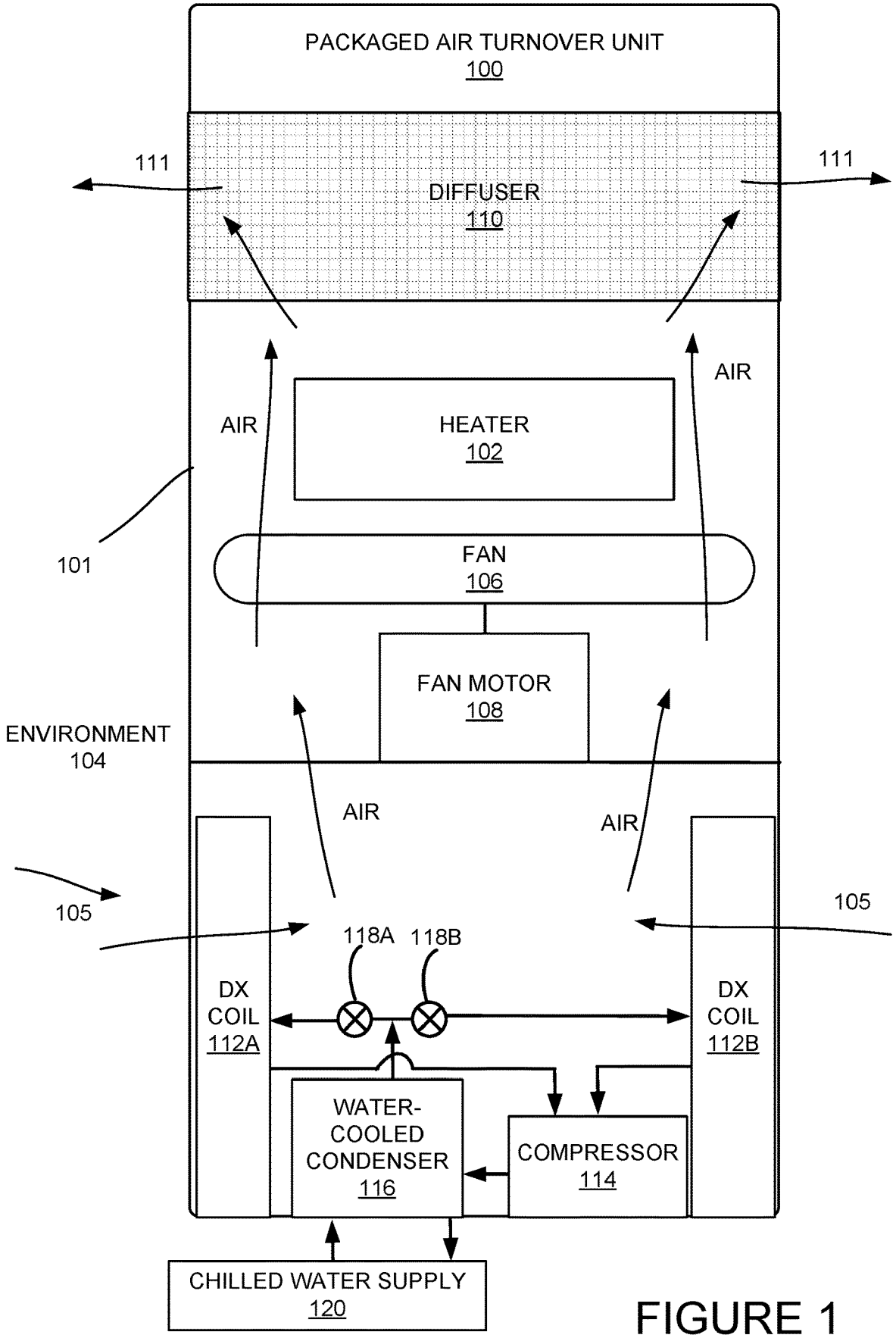
FIG. 1 is a diagram showing an exemplary packaged air turnover unit.

Embodiments of the disclosure presented herein encompass technologies for a packaged air turnover unit. In conventional air turnover units, when using a refrigerant evaporator (DX) coil, there is typically a remotely mounted condensing unit (or units) located outside of a space that is being cooled or heated using the conventional air turnover unit. Large refrigerant piping is run from the condensing units to the air turnover units for refrigeration (or cooling) of air to be turned over. If conventional air turnover units have chilled water coils, then conventional uses are typically characterized by a chiller system in a facility away from the air turnover unit. Pumps are used to pump chilled water through piping to the air turnover unit to provide cooling.

These types of systems can result in various disadvantages. For example, the remote location of components used in an air turnover unit means that maintenance, if needed, is often performed in two locations: the location of the air turnover unit and the location of the DX compressor(s). Further, if the maintenance is performed during inclement weather, because of the conventional location of the remote units, there is a probability that the maintenance worker will be exposed to the inclement weather. Additionally, because of the extensive use of piping, the pipes typically must be insulated to reduce the rate of heating of the fluid in the pipes from ambient air. Still further, the increased distance increases the amount of equipment or material that may suffer a defect. Several other disadvantages may be present in conventional systems.

The presently disclosed subject matter solves some of the disadvantages present in some conventional systems by modifying the arrangement of various components to provide a packaged air turnover unit. In some examples, the packaged air turnover unit includes one or more compressors within a housing of the air turnover unit. Using internal compressors rather than external units often requires only cooling water to be piped from a cooling tower to the packaged air turnover unit. Packaged air turnover units which utilize DX coils would not require remote condensing units with all the disadvantageous refrigerant piping and refrigerant.

In some examples, the packaged air turnover unit may have 1/10th (or more) the amount of refrigerant in the system to provide the cooling. In some examples, the packaged air turnover unit may eliminate the need for remote mounted chillers that provide the chilled water to the air turnover unit for cooling. Various types of compressors may be used and are considered to be within the scope of the presently disclosed subject matter. For example, types of compressors include, but are not limited to, reciprocating, scroll, screw, rotary air, and centrifugal compressors. Various types of DX coils may be used. For example, a standard copper tube or an aluminum fin coil may be used.

In other examples, a microchannel coil may be used. Microchannel condenser coils can be all aluminum coils with multiple flat tubes containing small channels (microchannels) through which refrigerant flows. Heat transfer can be increased or maximized by the insertion of angled and louvered fins in-between the flat tubes. In some examples, evaporators used as DX coils may be copper tube, but the presently disclosed subject matter is not limited to the use of a copper tube evaporator, as other evaporators may be used, including, but not limited to, an aluminum fin coil or microchannel coil.

In some examples, the packaged water-cooled DX air turnover unit may also be more efficient than a standard air turnover system using remote condensers or chillers. Compared to conventional air turnover units with remote condensers, the water-cooled, packaged air turnover unit may be almost 40% more efficient than an air-cooled system. Compared to a chilled water system, a water-cooled, DX coil, packaged air turnover unit may be about 15% more efficient due to the elimination of the chilled water pumping systems and other system losses. In some examples, the installed cost of the packaged air turnover unit may be less than the typical systems mentioned above.

In the following detailed description, references are made to the accompanying drawings that form a part hereof, and in which are shown by way of illustration specific embodiments or examples. Referring now to the drawings, aspects of an exemplary operating environment and some example implementations provided herein will be described.

FIG. 1 is diagram showing an exemplary packaged air turnover unit 100. The packaged air turnover unit 100 includes a housing 101. The housing 101 encloses a heater 102 which provides heat to incoming air. The heater 102 can be various types of heaters, including, but not limited to, direct-fired or indirect-fired heaters. A natural gas or propane direct fired heater has an open flame that provides a way to heat industrial and commercial areas by maintaining a proper air-to-fuel ratio. In a direct fired heater, the gas is fed directly to the burner while the airstream provides the needed oxygen for combustion. Air is forced through the burner baffle where it mixes with the gas. The burner is installed to fire with, and parallel to, the airflow. In an indirect fired heater, the burner is fired into a heat exchanger. Air is heated by passing over the heat exchanger, allowing the combustion by-products to remain within the heat exchanger which is then exhausted through a flue. An everyday example of an indirect fired heater would be a gas furnace with a chimney.

Air is pulled from the environment 104 (generally identified as "Air" in FIG. 1) through air intake 105 around the packaged air turnover unit 100 using a fan 106 enclosed within the housing 101. The fan 106 is rotated using a fan motor 108. In a heating mode, air is pulled in from the environment 104 using the fan 106, heated by heater 102, and exhausted back into the environment 104 through a diffuser 110, which helps direct the air, and air exhausts 111.

To provide cooling to the incoming air, the packaged air turnover unit 100 housing 101 encloses one or more heat exchangers. In FIG. 1, the heat exchangers are direct expansion (DX) coils 112A and 112B, though other types of heat exchangers may be used. In a DX coil, a refrigerant is pumped through the inside of the DX coils 112A and 112B, with air passing around the DX coils 112A and 112B. Heat is exchanged from the air to the refrigerant, reducing the temperature of the air. The DX coils 112A and 112B provide cooling by directly cooling the air used for cooling the environment 104 by the refrigerant inside the coils of the DX coils 112A and 112B. Cooling occurs through the expansion of the refrigerant. In a direct expansion or DX types of air central conditioning plants the air used for cooling space is directly chilled by the refrigerant in the cooling coil of the air handling unit. Since the air is cooled directly by the refrigerant the cooling efficiency of the DX plants may be higher. In some examples, the DX coils 112A and 112B are placed proximate to the air intake 105 so that air 104, when pulled into the housing 101 by fan 106, moves through the DX coils 112A and 112B.

A compressor 114 enclosed within the housing 101 is used to compress a refrigerant that runs through the compressor 114, through the DX coils 112A and 112B and into a water-cooled condenser 116, also enclosed within the housing 101. The compressor 114 is used to compress a refrigerant so that the refrigerant leaves the compressor 114 as a high pressure, high temperature vapor. The high temperature, high pressure refrigerant enters the water-cooled condenser 116. The condenser 116 de-superheats, condenses, and sub-cools the refrigerant, whereby the refrigerant leaves the condenser 116 as a high pressure, high temperature liquid and enters expansion valves 118A and/or 118B, further enclosed within the housing 101. The expansion valves 118A and/or 118B reduce the pressure and temperature of the refrigerant, whereby the refrigerant enters DX coils 112A and 112B as a low pressure, low temperature liquid/vapor mixture. The air from the environment 104 passes over the DX Coils 112A and 112B. The air is cooled as the heat from the air is absorbed by the refrigerant moving through the DX coils 112A and 112B. The refrigerant leaves the DX coils 112A and 112B as a low temperature low pressure vapor and re-enters the compressor 114.

It should be noted that the expansion valves 118A and 118B may be located within or close to the DX coils 112A and 112B. The water-cooled condenser 116 receives chilled water from a chilled water supply 120. The chilled water reduces the temperature of the vaporized, heated refrigerant to be compressed by the compressor 114. The refrigerant exits the compressor 114 and expands, which pulls heat from the air moving through the DX coils 112A and 112B, reducing the temperature of the air. Various forms of refrigerant may be used and are considered to be within the scope of the presently disclosed subject matter. Various types of expansion valves may be used and are considered to be within the scope of the presently disclosed subject matter. For example, the expansion valves 118A and 118B may be thermostatic expansion valve or an electronic expansion valve.

Figure 2:
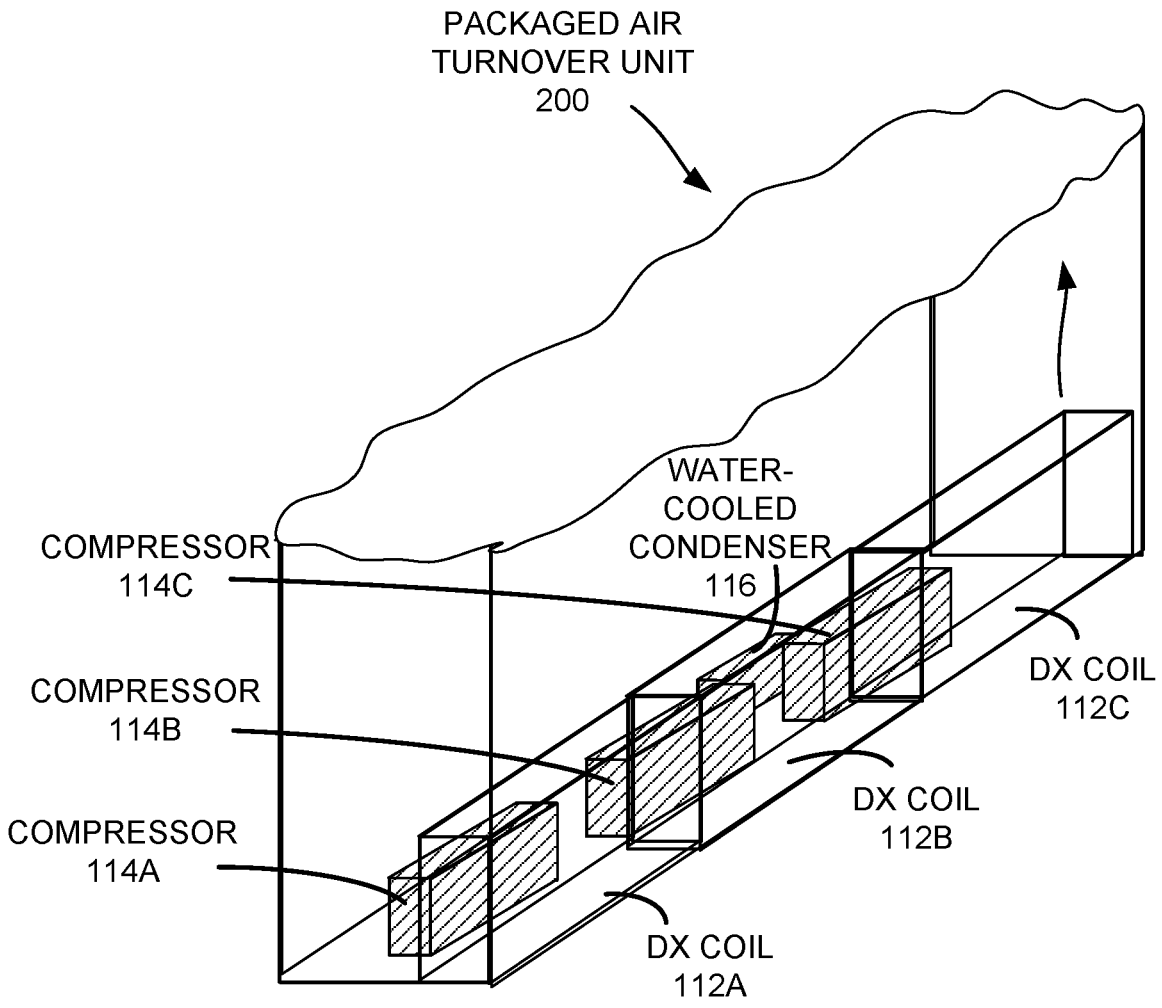
FIG. 2 is a diagram showing multiple compressors in a packaged air turnover unit.

FIG. 2 is a diagram showing multiple compressors in a partial view of a packaged air turnover unit 200. The packaged air turnover unit 200 includes DX coils 112A, 112B, and 112C. The packaged air turnover unit 200 further includes compressors 114A, 114B, and 114C. The packaged air turnover unit 200 further includes the water-cooled condenser 116. The packaged air turnover unit 200 of FIG. 2 operates in a similar manner to the packaged air turnover unit 100 of FIG. 1. However, as shown in FIG. 2, the packaged air turnover unit 200 can include more than one compressor.

Based on the foregoing, it should be appreciated that technologies for a packaged air turnover unit have been disclosed herein. The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

The invention claimed is:

1. An air turnover unit located within an interior space, the air turnover unit comprising:

a housing having an air intake for intaking air from the interior space and an air exhaust for exhausting the air into the interior space; enclosing:

a first direct expansion heat exchanger and a second direct expansion heat exchanger configured to exchange heat from interior space air moving around a coil of the heat exchanger to a refrigerant that is compressible moving through the coil of the heat exchanger;

a fan configured to:

pull air into the housing through the air intake, through the heat exchanger, and out of the housing through the air exhaust;

a compressor configured to compress the refrigerant received from the first direct expansion heat exchanger and a second direct expansion heat exchanger;

a condenser cooled by chilled water, the condenser configured to cool and condense the refrigerant received from the compressor prior to entering either the first direct expansion heat exchanger or the second direct expansion heat exchanger; and an expansion valve configured to reduce a temperature and pressure of the refrigerant received from the condenser;

a chilled water supply configured to supply chilled water to the condenser;

a diffuser to direct air to the air exhaust; and a heater to heat the air exhausting into the interior space.

2. The air turnover unit of claim 1, wherein the heater is a direct-fired heater.

3. The air turnover unit of claim 1, wherein the heater is an indirect-fired heater.

* * * * *